US007441982B1

(12) United States Patent
Al-Sabah

(10) Patent No.: US 7,441,982 B1
(45) Date of Patent: Oct. 28, 2008

(54) PORTABLE TRAFFIC CONTROL BARRIER

(76) Inventor: Sabah Naser Al-Sabah, P.B. 36777, Al-Ras (KW) 24758

( * ) Notice: Subject to any disclaimer, the term of this patent is extended or adjusted under 35 U.S.C. 154(b) by 0 days.

(21) Appl. No.: 11/353,864

(22) Filed: Feb. 14, 2006

Related U.S. Application Data

(60) Provisional application No. 60/652,595, filed on Feb. 14, 2005.

(51) Int. Cl.
*E01F 13/12* (2006.01)

(52) U.S. Cl. ..... 404/6

(58) Field of Classification Search ..... 40/606.15, 40/612; 404/9, 10, 15, 6; 49/49; *E01F 13/12*
See application file for complete search history.

(56) References Cited

U.S. PATENT DOCUMENTS

| | | | | | |
|---|---|---|---|---|---|
| 1,563,637 | A * | 12/1925 | Lundblad | 49/49 |
| 1,776,447 | A * | 9/1930 | Parkhurst | 404/10 |
| 1,888,590 | A * | 11/1932 | Greenlee | 404/10 |
| 2,175,636 | A * | 10/1939 | Morgan | 49/134 |
| 2,762,145 | A * | 9/1956 | Rupe | 49/49 |
| 3,748,782 | A * | 7/1973 | Reynolds | 49/49 |
| 3,805,448 | A * | 4/1974 | Carr et al. | 49/49 |
| 3,838,391 | A * | 9/1974 | Mintz | 340/935 |
| 3,849,936 | A * | 11/1974 | Geraci | 49/35 |
| 4,354,771 | A * | 10/1982 | Dickinson | 404/6 |
| 4,822,206 | A * | 4/1989 | Roussel et al. | 404/6 |
| 5,452,964 | A * | 9/1995 | Trougouboff | 404/10 |
| 6,010,277 | A * | 1/2000 | Follman | 404/11 |
| 6,398,452 | B1 * | 6/2002 | Wagner et al. | 404/6 |
| 6,457,900 | B2 * | 10/2002 | Bond | 404/15 |
| 7,118,304 | B2 * | 10/2006 | Turpin et al. | 404/6 |

FOREIGN PATENT DOCUMENTS

EP 0 507 624 * 10/1992

* cited by examiner

*Primary Examiner*—Gary S Hartmann
(74) *Attorney, Agent, or Firm*—Allen Dyer Doppelt Milbrath & Gilchrist

(57) ABSTRACT

A portable traffic control device includes a base member having a lengthwise extent, a generally rectangular cross section, an upper side, a lower side, a front side and a rear side. A plurality of brackets is connected to and extending from front side and rear side peripheries of said base member, each individual bracket of said plurality of brackets having an opening to receive a mechanical fastener therethrough so as to fasten said traffic control barrier to an underlying support, the opening lying approximately on an imaginary plane coextensive with the lower side of said base member. One or more biasing hinge members are connected to the rear side of said base member. A support frame is pivotally connected to said one or more biasing hinge members and a barrier member connected to said support frame, said barrier member extending along the lengthwise extent of said base member and being pivotally biased toward the front side of said base member.

11 Claims, 12 Drawing Sheets

PORTABLE TRAFFIC CONTROL BARRIER

RELATED APPLICATION

This application claims priority from provisional application Ser. No. 60/652,595 which was filed on Feb. 14, 2005, and which is incorporated herein by reference in its entirety.

FIELD OF THE INVENTION

The present invention relates to the field of barriers and, more particularly, to a traffic control barrier which provides selective access responsive to vehicle speed.

BACKGROUND OF THE INVENTION

Traffic control is a problem in most countries having a significant number of motor vehicles moving on the highways. In the most severe cases of traffic congestion, special lanes are established either for use by emergency vehicles, carpools, and other special uses. It is important to discourage unauthorized drivers from encroaching on these restricted lanes in order to maintain lane availability for the designated special use. Moreover, there is often a need for denying vehicular traffic entry to certain areas, such as security zones and the like.

Accordingly, the present invention provides a traffic control barrier that may be manufactured in small, portable versions for use by police departments and others in temporarily restricting vehicular traffic from certain highway lanes or areas to be secured. Additionally, a larger embodiment of the invention may also be fabricated for permanent use controlling traffic on highways and parking lots.

SUMMARY OF THE INVENTION

With the foregoing in mind, the present invention advantageously provides a portable traffic control device. The apparatus of the invention is variously identified as a traffic control device, a traffic barrier or a portable curb for traffic control.

In one embodiment of the invention, the device comprises a base member having a lengthwise extent, a generally rectangular cross section, an upper side, a lower side, a front side and a rear side. A plurality of brackets is connected to and extends from front side and rear side peripheries of said base member, each individual bracket of said plurality of brackets having an opening to receive a mechanical fastener therethrough so as to fasten said traffic control barrier to an underlying support, the opening lying approximately on an imaginary plane coextensive with the lower side of said base member. One or more biasing hinge members are connected to the rear side of said base member. A support frame is pivotally connected to said one or more biasing hinge members and a barrier member connected to said support frame, said barrier member extending along the lengthwise extent of said base member and being pivotally biased toward the front side of said base member.

Optionally, the traffic control device includes a base member that comprises hollow metal. Each biasing hinge member may include a biasing element selected from a spring, a fluid compression cylinder, and combinations thereof. The skilled will recognize that a fluid compression cylinder would include a pneumatic pressure cylinder. Furthermore, said one or more biasing hinge members may consist of spring-loaded hinges. Preferably, the plurality of brackets, the one or more biasing hinge members, said support frame and said barrier member are all made of metal. The barrier member is preferably a plate and best extends along the entire lengthwise extent of said base member and includes a relatively sharp edge along an upper periphery. In a preferred embodiment, the entire device is made of metal and the connections consist of welds.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

Figure 1:
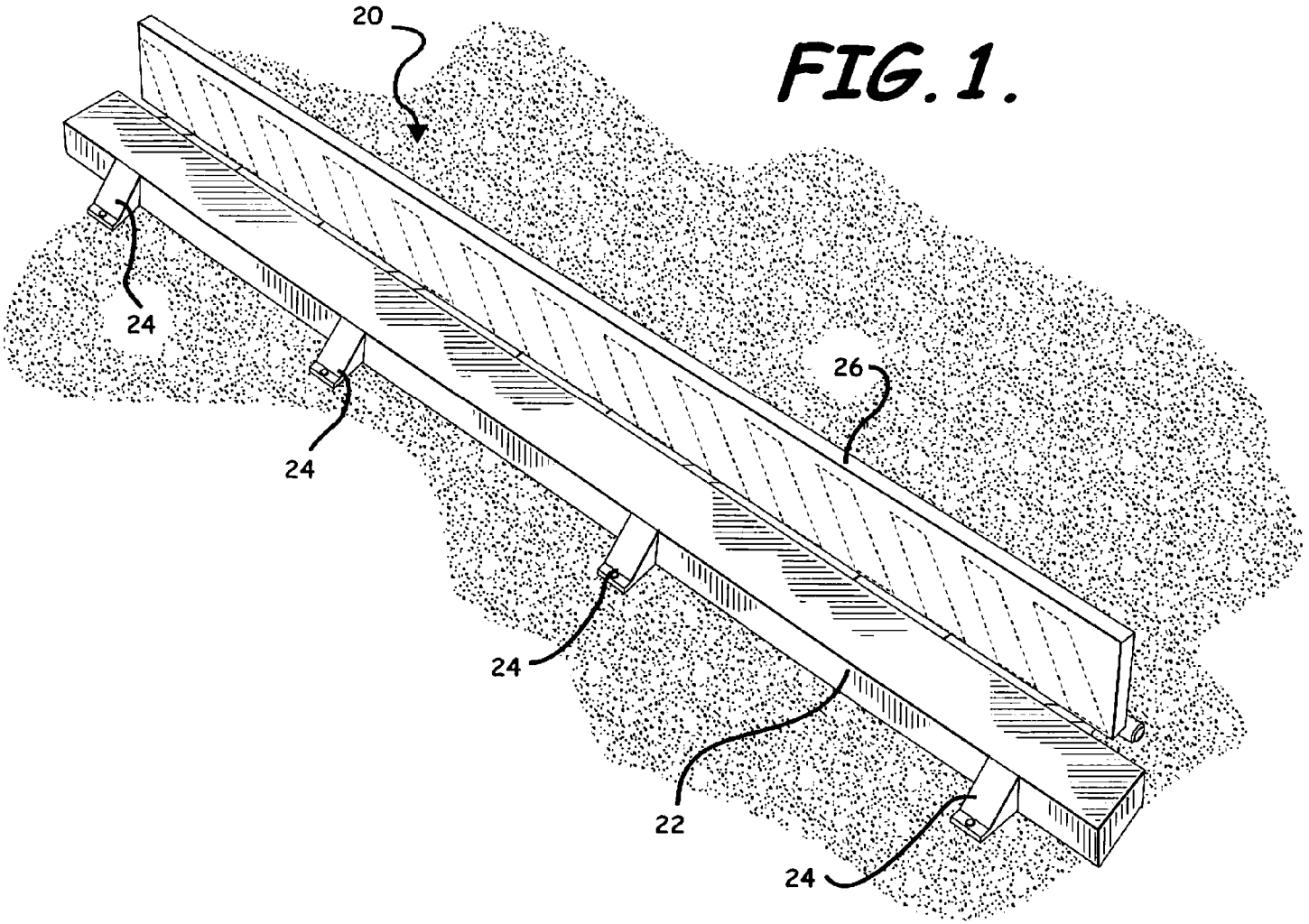
FIG. 1 is a perspective view of the traffic control barrier according to an embodiment of the present invention.
Figure 2:
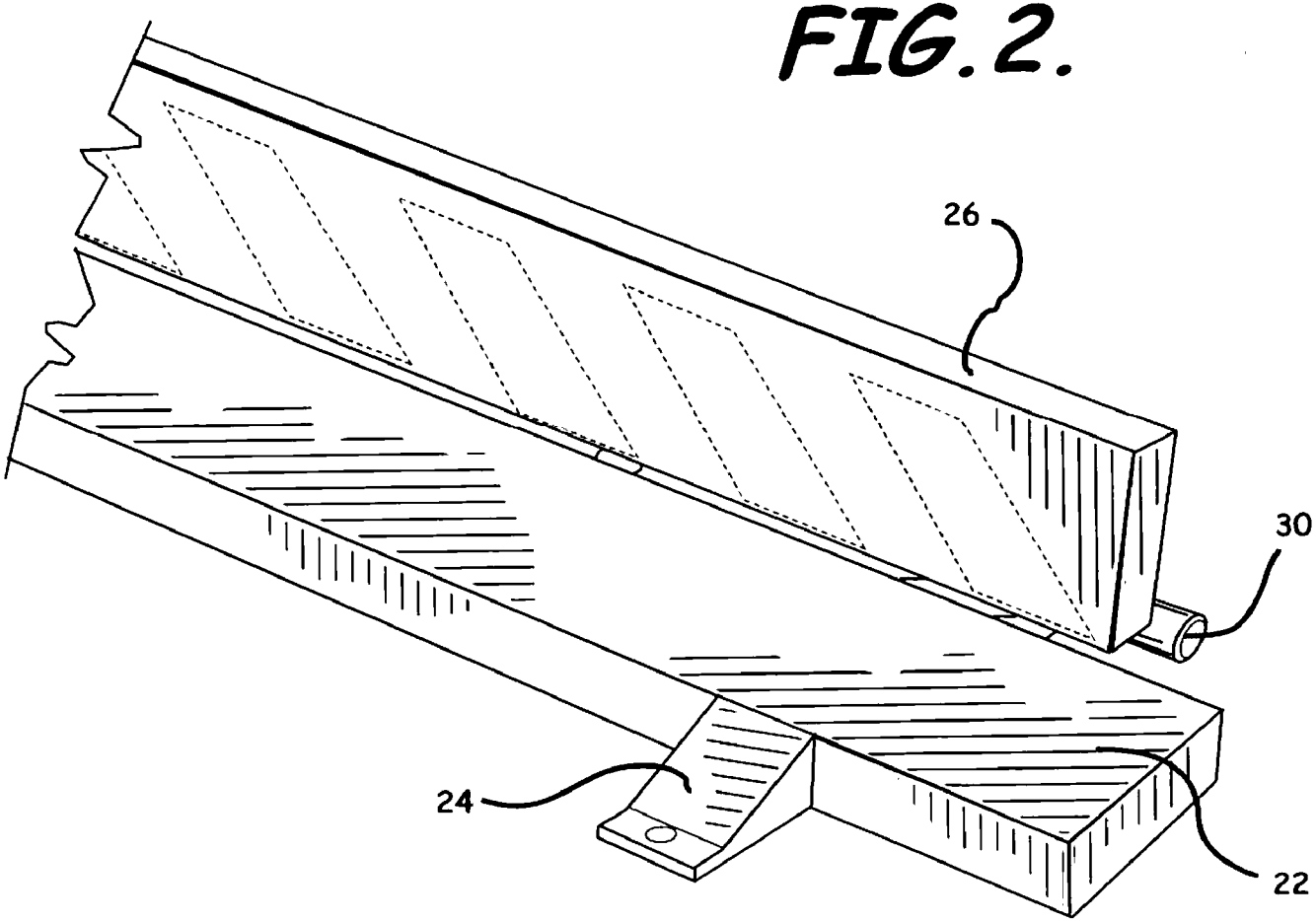
FIG. 2 is a closeup view of an end of the barrier of FIG. 1.
Figure 3:
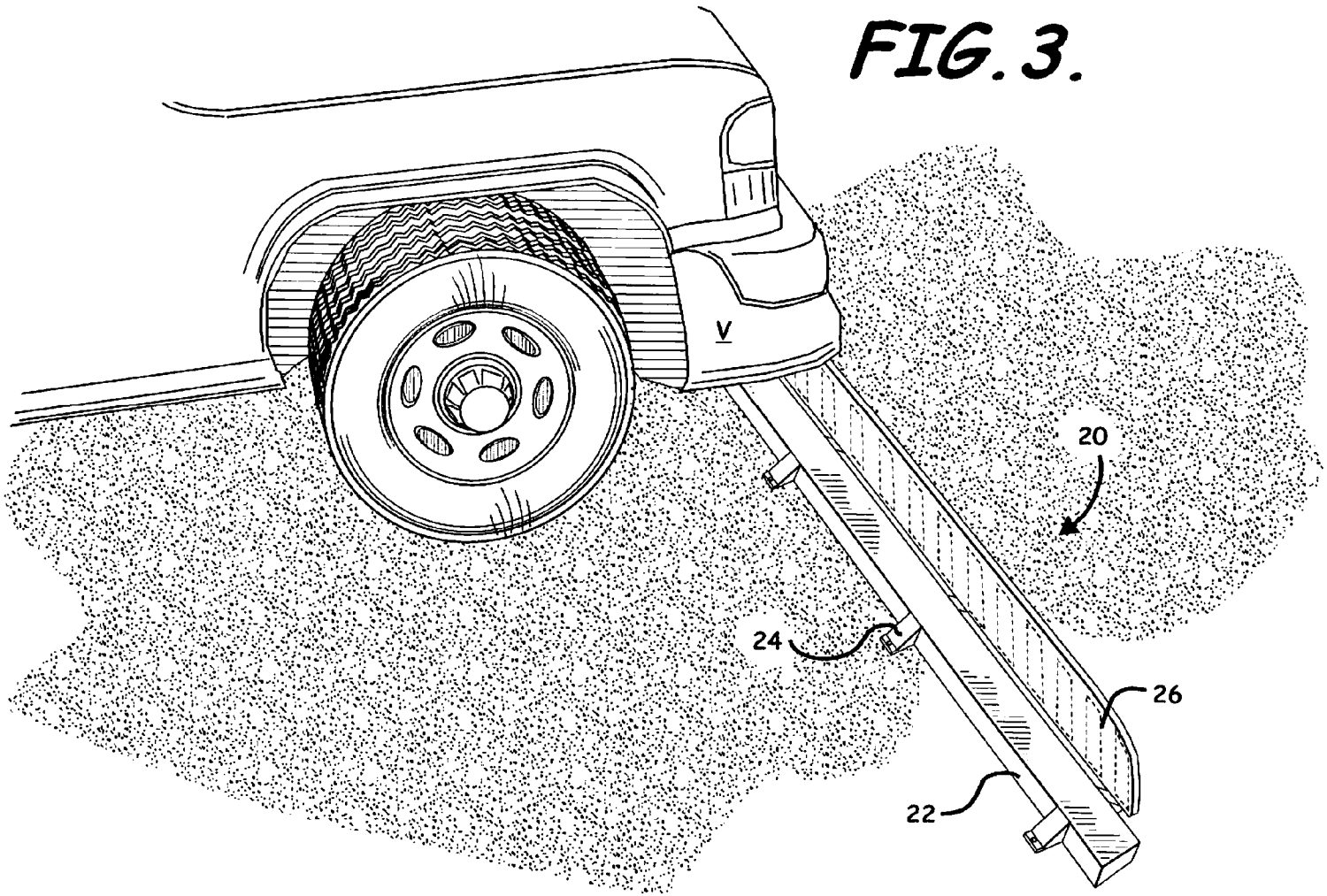
FIGS. 3-8 is a sequence of images showing the barrier of FIG. 1 in operation as a vehicle drives over the barrier.
Figure 4:
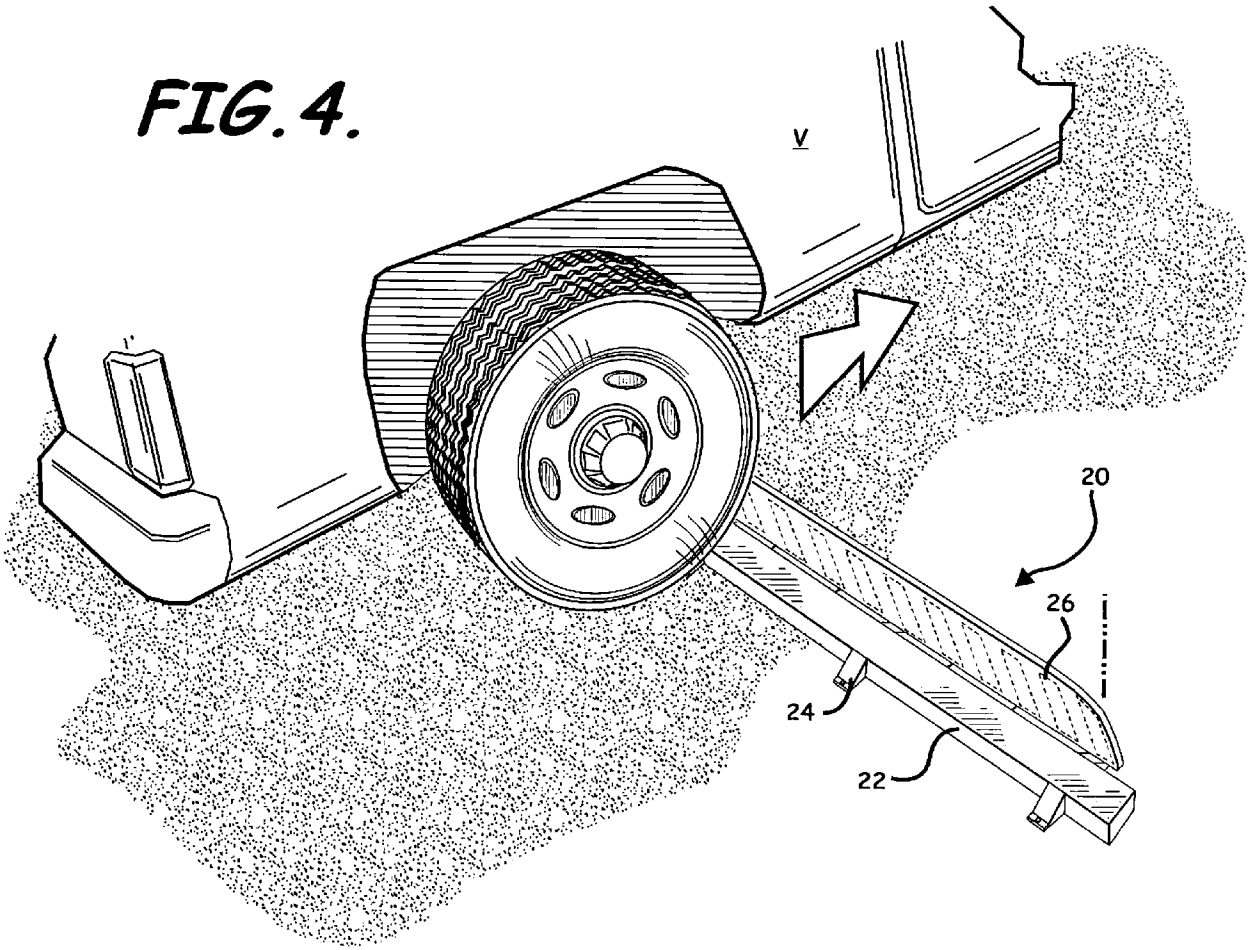
Figure 5:
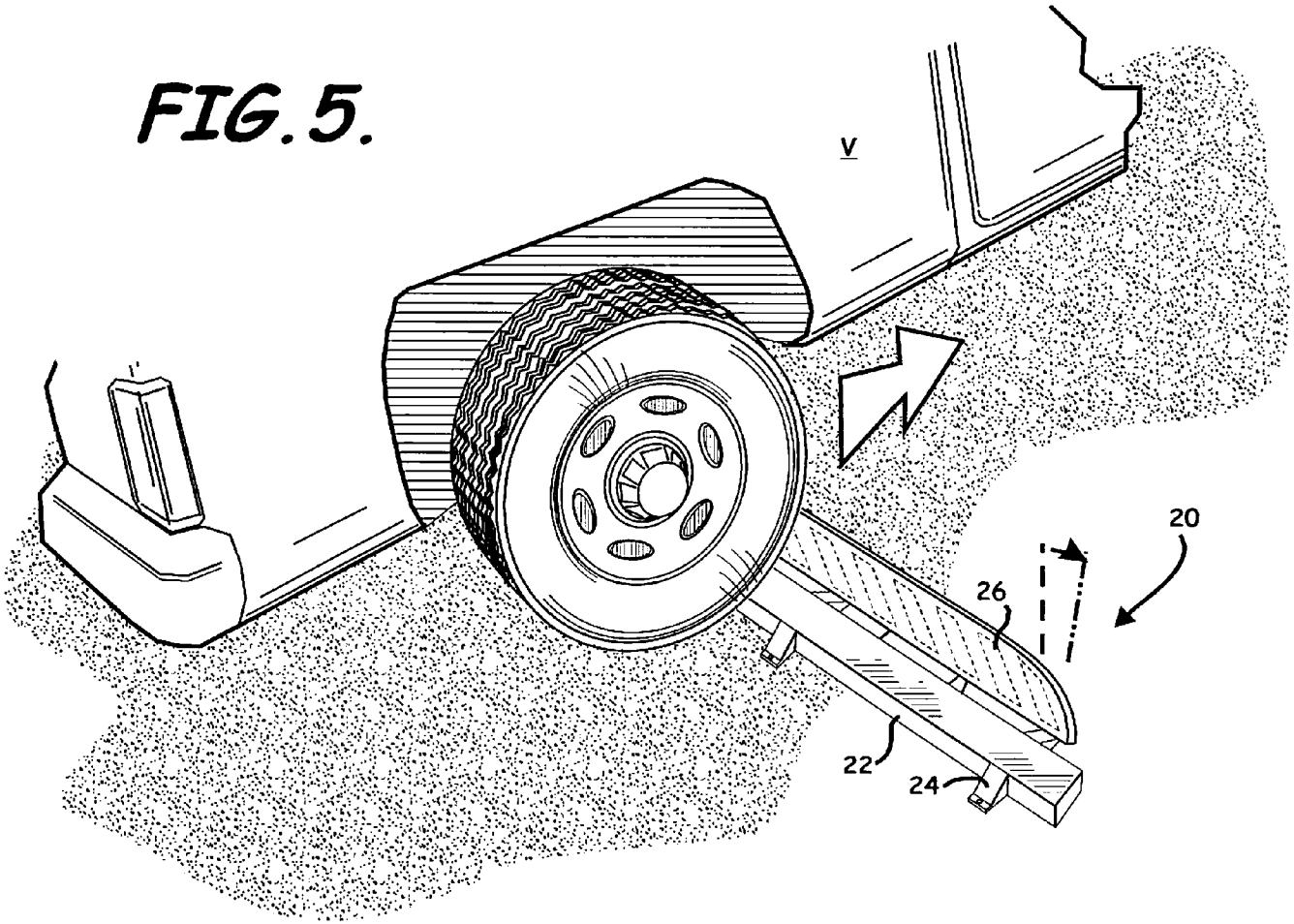
Figure 6:
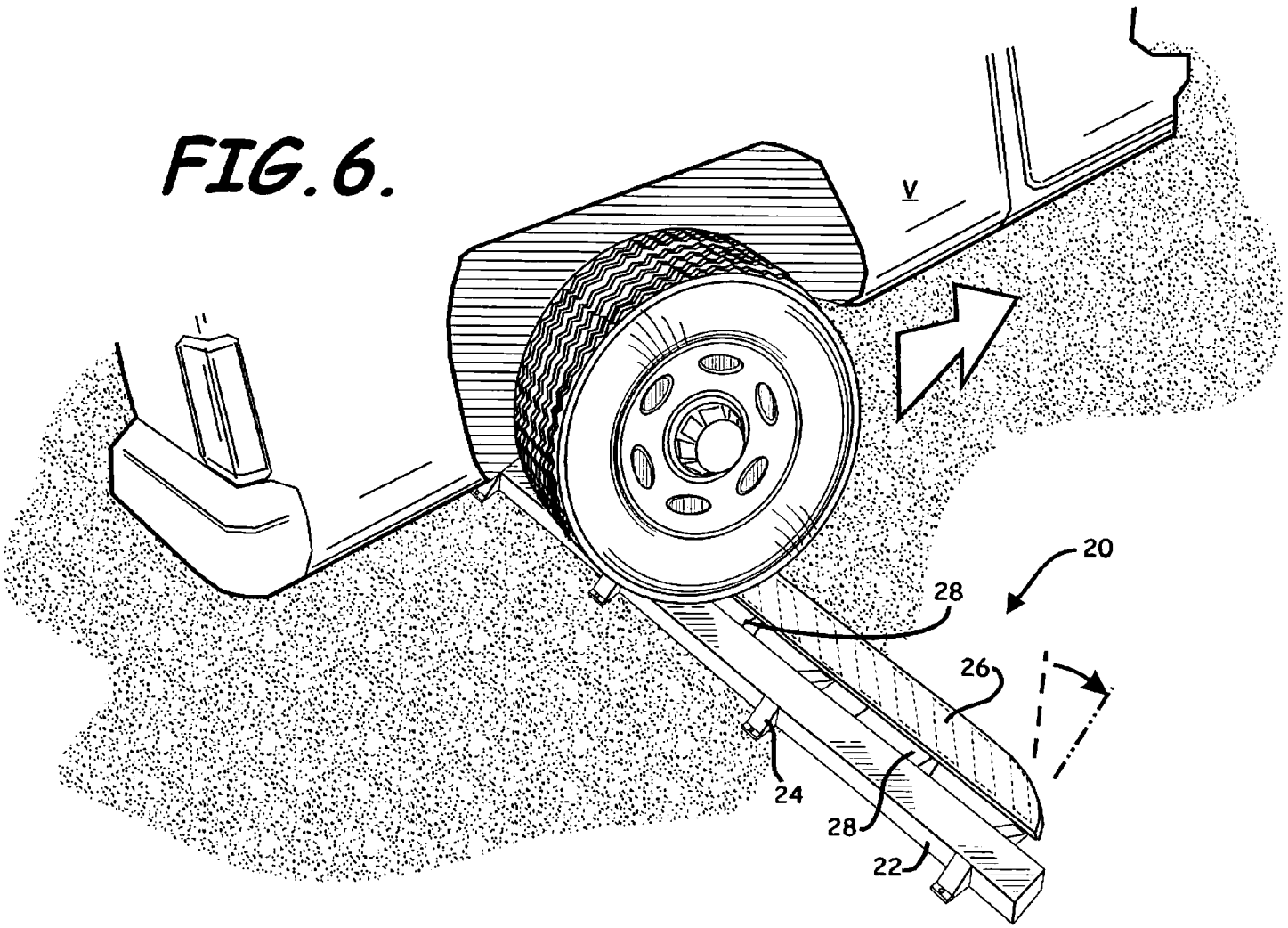
Figure 7:
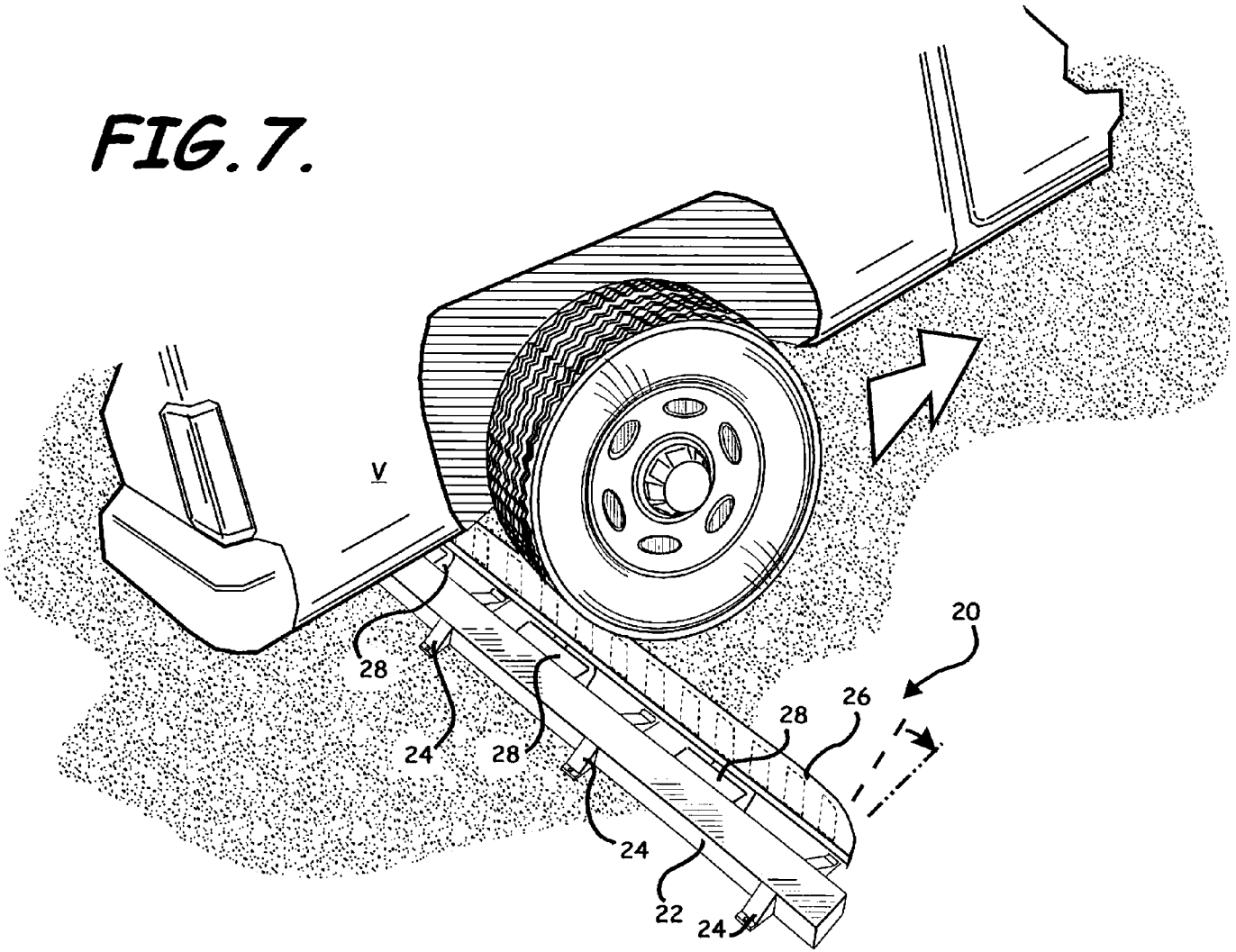
Figure 8:
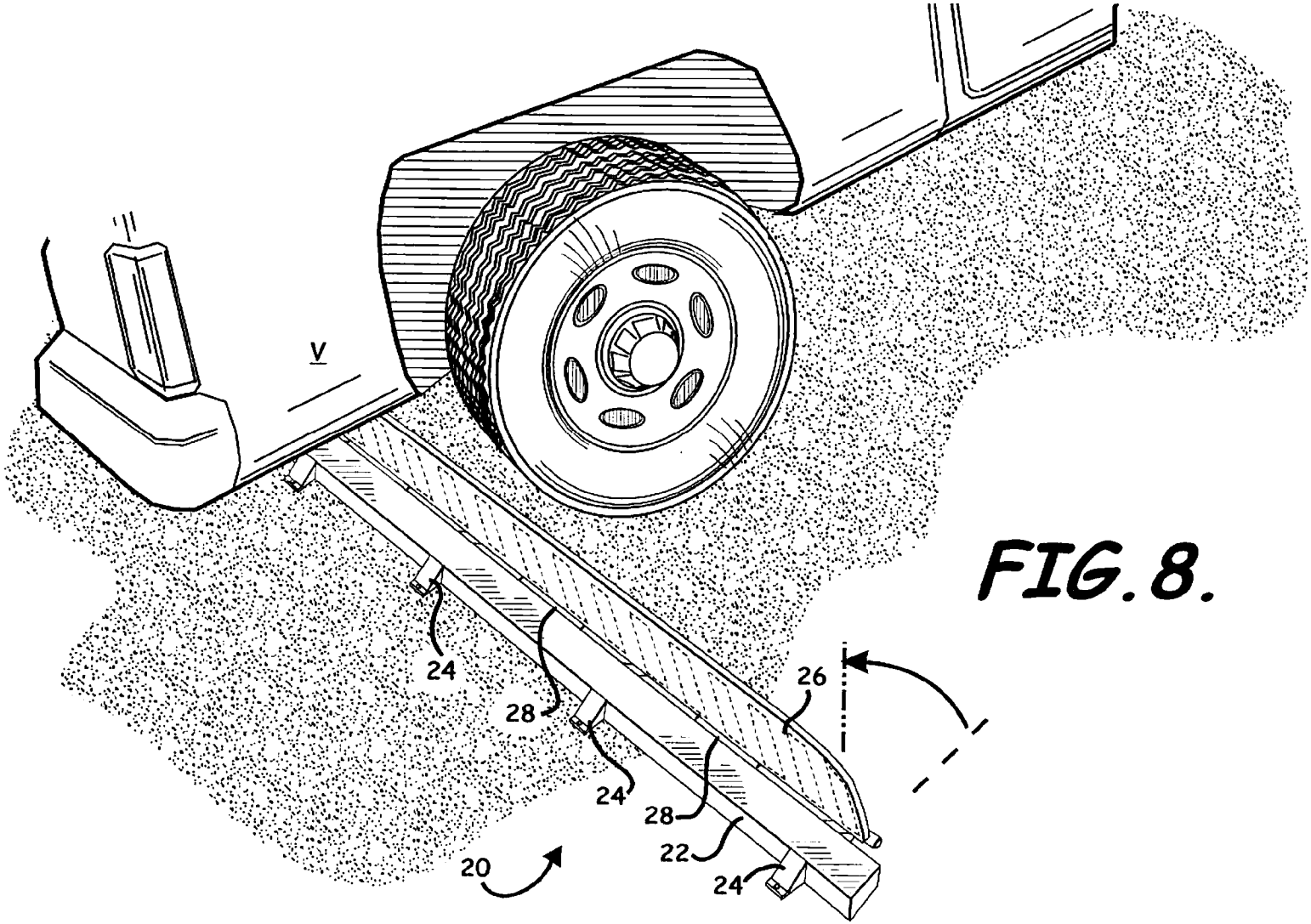

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

The skilled will appreciate that the drawings of the invention, as shown in FIGS. 1-11 are fairly self-explanatory. The present traffic control barrier 20 comprises a base member 22 having a plurality of brackets 24 by which the barrier may be fastened to an underlying surface, such as a road or parking lot. The base member 22 is preferably elongated and rectangular in cross-section to allow it to sit squarely on the underlying surface, as shown in the figures. Most preferably, one long side of the rectangular cross-section will abutt the road surface and the other long side will face upwardly from the road surface. The short sides of the rectangular cross-section provide the base member's height above the road surface, as shown. Typically, the traffic control barrier 20 will be manufactured of metal, particularly steel, although it could also be made of other weather resistant materials, such as certain plastics.

As also shown in the figures, a barrier member 26 is pivotally connected to the base member 22 so that the barrier member extends upwardly from the base member. The barrier member 26 preferably comprises an elongated panel or plate extending along the length of the base member 22, as seen in FIGS. 1-9. The barrier member 26 preferably is connected extending upwardly from the base member 22 at an angle whose particular orientation will depend on the intended placement and use of the barrier. For example, while a 90° angle relative to the base member 22 would orient the barrier member 26 perpendicular to the base member, the angle may be more or less than that, depending on the requirements of barrier placement. The barrier member 26 may be oriented at an angle of less than 90° so that the barrier member inclines toward the traffic, or it may be oriented at an angle of more than 90° so that the barrier member inclines away from the traffic.

Figure 9:
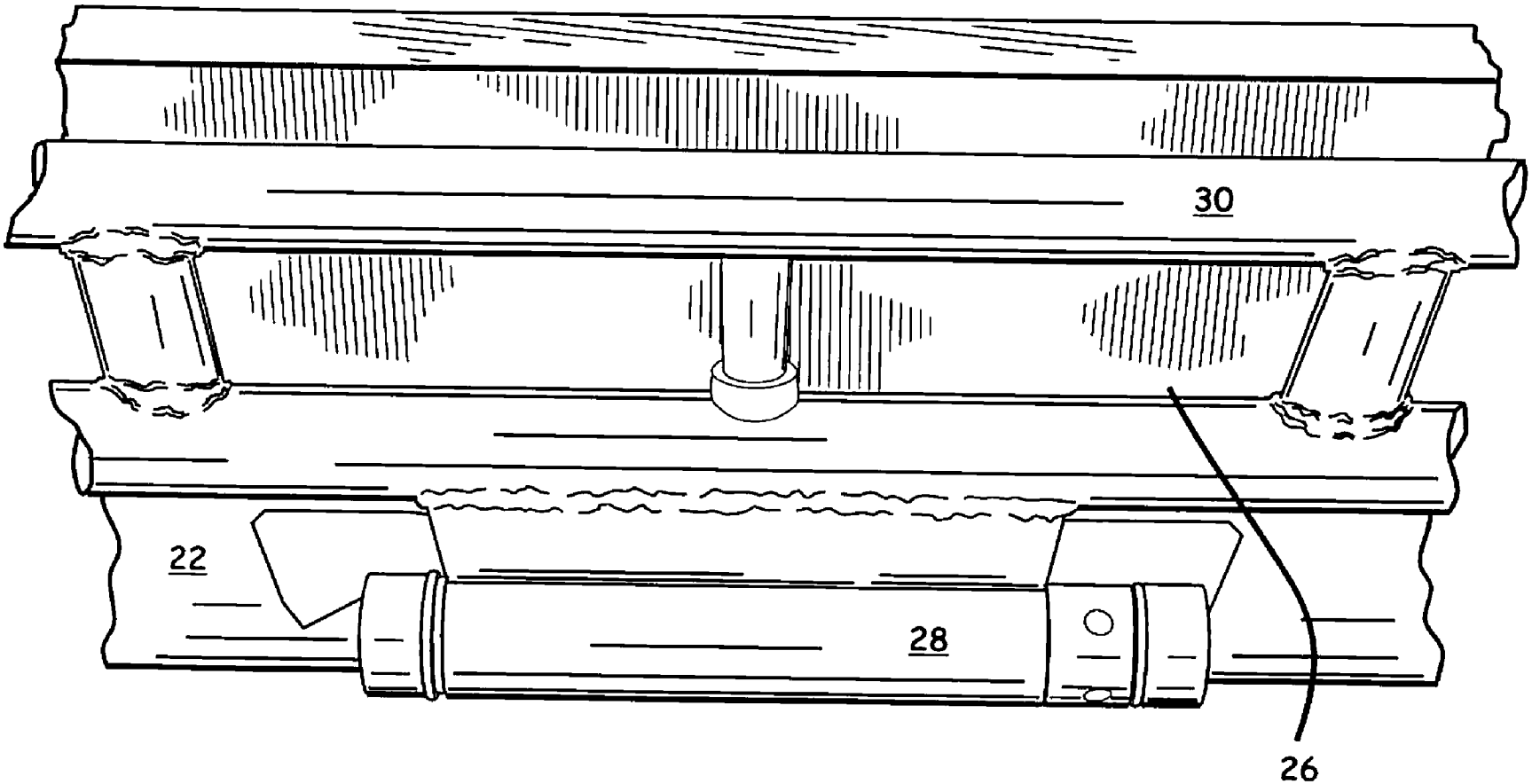
FIG. 9 is a rear view of the barrier of FIG. 1 showing detail of the back side of the barrier member and its support frame connected to the hinge.
Figure 10A:
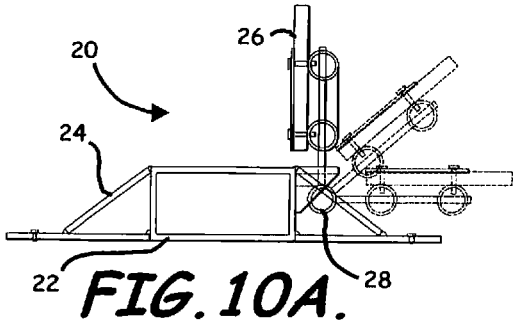
FIGS. 10-11 are engineering drawings of the barrier of FIG. 1, showing structural details and preferred dimensions for the barrier.
Figure 10B:
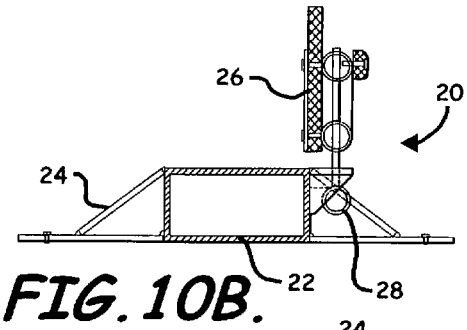
Figure 10C:
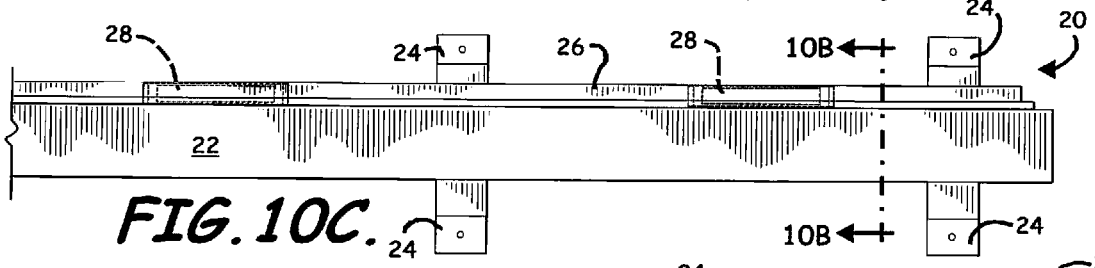
Figure 10D:
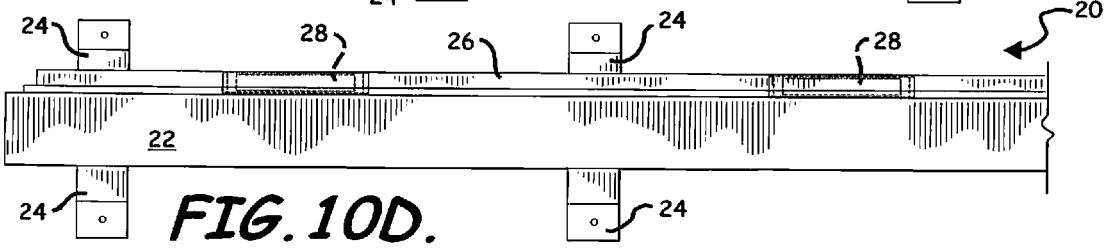
Figure 11A:
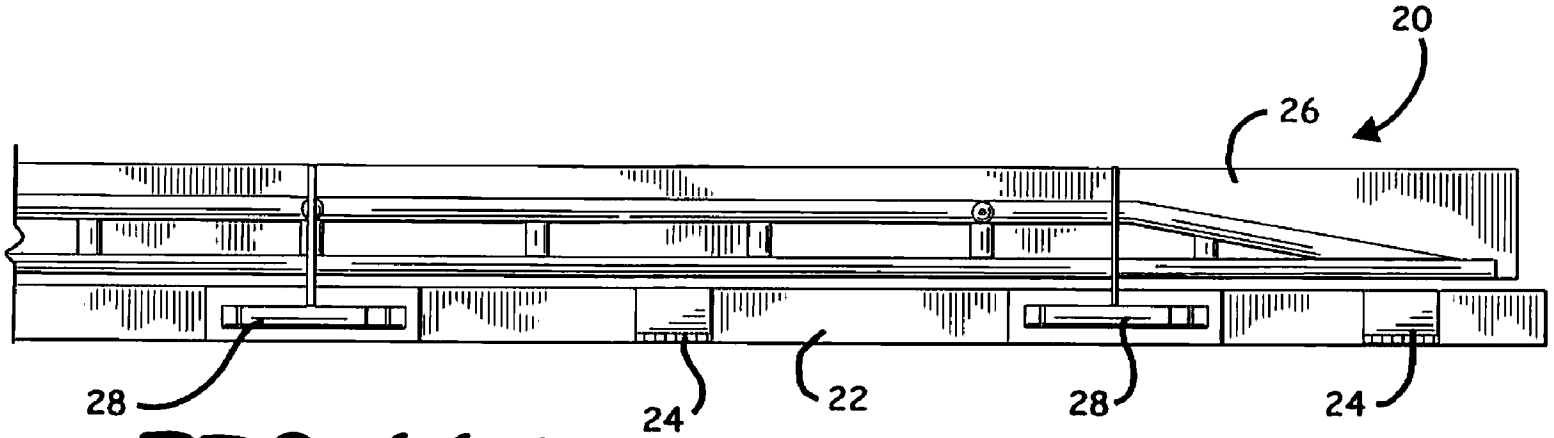
Figure 11B:
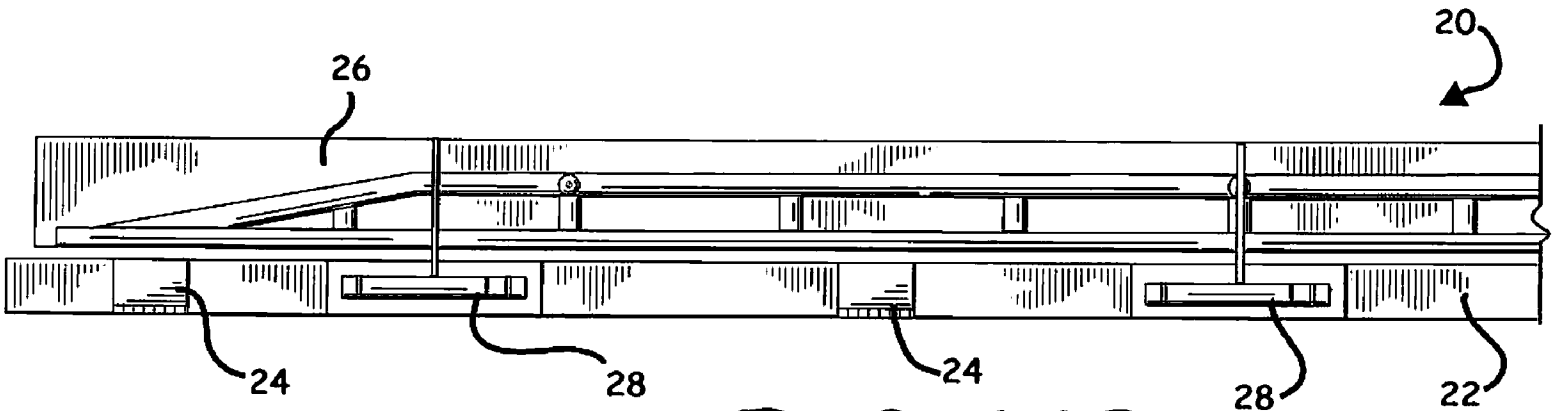
Figure 11C:
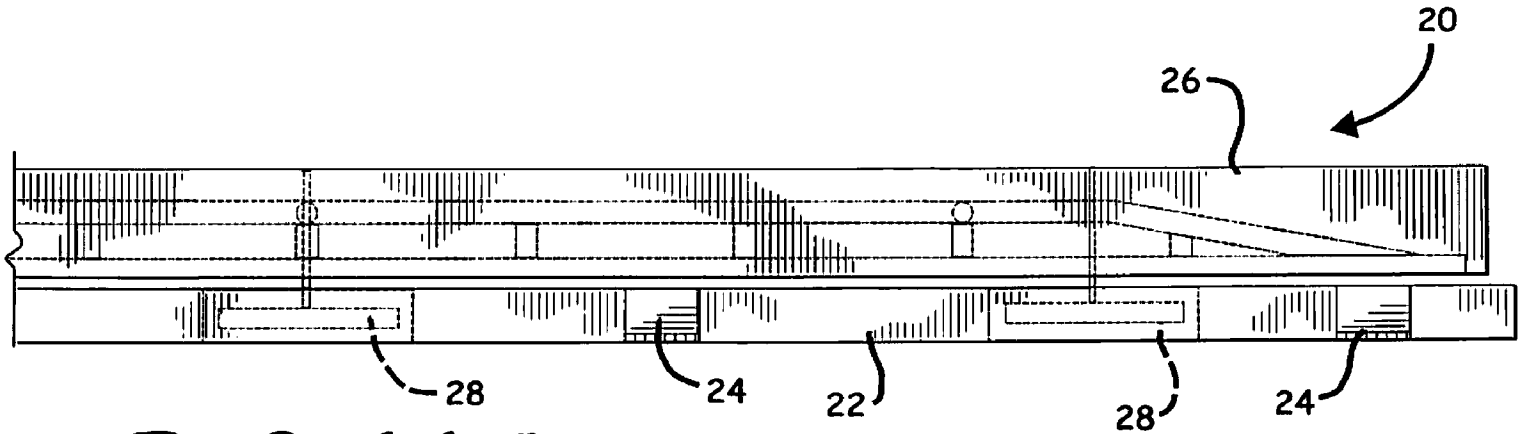
Figure 11D:
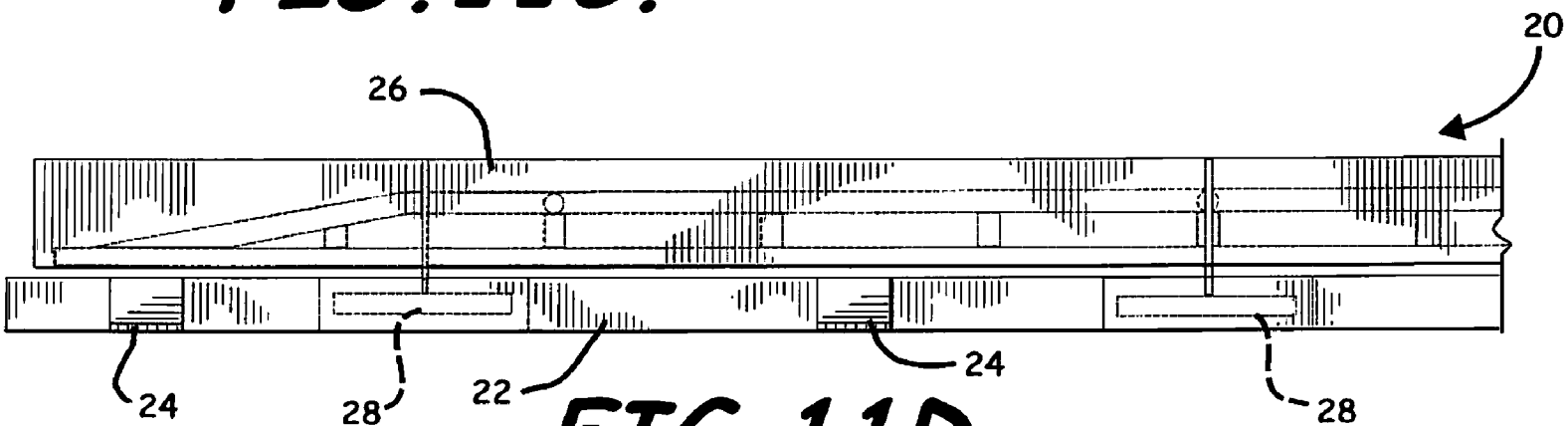

The barrier member 26 is connected to the base member 22 by one or more hinge members 28 which comprise a biasing device such as a spring or a fluid compression cylinder. As shown in FIG. 9, the hinge member 28 is positioned along an external lengthwise extent of the base member 22. The barrier member 26 may be fastened directly to the hinge member 28 or may include a support frame 30 which is secured to the hinge member, as shown in FIG. 9.

As illustrated in FIGS. 3-8, a motor vehicle V may drive over the traffic control barrier 20 by approaching slowly and gently rolling over the barrier member 26 as it folds down on its hinge(s) responsive to the weight of the vehicle's tires. While presence of the barrier 20 will discourage drivers from crossing over into the restricted area, proper angling of the barrier member relative to the traffic would permit carefully and slowly crossing the barrier without damage to the vehicle's tires. However, if the barrier member 26 is sufficiently angled toward the direction of traffic, a vehicle attempting to drive over the barrier would suffer severe tire damage, as the barrier member so oriented would not fold down backwardly when pressed upon by a vehicle's tires.

In this embodiment, the angle of said one or more barrier members 26 and the biasing force applied thereto by said at least one biasing member 28 are coordinated to allow said one or more barrier members to pivot backwardly toward the rear side of said base member 22 responsive to a force applied to said one or more barrier members in a direction approximately parallel to the one or more substantially flat portions along the bottom side of said base member. As can be seen, particularly in FIGS. 4-6, the vehicle's V tire slowly applies such a force to the barrier member 26, causing it to pivot backwardly toward the rear side of the base member 22. In this manner, by approaching slowly, a vehicle V may go over the present traffic barrier 20 without suffering damage to its tires. If, on the other hand, the vehicle V approaches at a high rate of speed, there will be insufficient time for the barrier member 26 to pivot backwardly and the tires will be damaged. Therefore, the present traffic control barrier 20 could be used, for example, to regulate traffic in parking lots, especially at an exit ramp to allow vehicles to leave the lot while preventing other vehicles from entering the lot through the exit.

Accordingly, in the drawings and specification there have been disclosed typical preferred embodiments of the invention and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as recited in the appended claims.

What is claimed is:

1. A traffic barrier comprising:

a base member for placement on an underlying surface, the base member having a front side and a rear side;

a barrier member having an upper edge adapted for inflicting tire damage to a vehicle; and a biasing member exerting a biasing force between the base member and the barrier member, the biasing force being exerted to bias the upper edge away from the rear side;

wherein a speed response of the biasing member is selected such that a vehicle crossing the barrier from the front side to the rear side:

at or below a given speed will overcome the biasing force enough to allow the upper edge to deflect harmlessly toward the rear side; and above the given speed will not overcome the biasing force enough to allow the upper edge to deflect harmlessly toward the rear side, leaving the upper edge in a position to inflict tire damage.

2. The traffic barrier of claim 1, wherein the base member includes a hollow metal element.

3. The traffic barrier of claim 1, wherein the biasing member includes a biasing element selected from a spring, a fluid compression cylinder and combinations thereof.

4. The traffic barrier of claim 1, wherein said barrier member extends along substantially the entire lengthwise extent of said base member.

5. The traffic barrier of claim 1, wherein the biasing member comprises a spring-loaded hinge.

6. The traffic barrier of claim 1, wherein the base member and the barrier member are longitudinally coextensive.

7. The traffic barrier of claim 1, wherein the barrier member includes at least one plate.

8. The traffic barrier of claim 1, wherein the base member is adapted for mounting directly on the underlying surface.

9. The traffic barrier of claim 1, wherein the barrier member is orientatable between angles greater than and less than 90 degrees relative to the base member.

10. The traffic barrier of claim 1, wherein the barrier member comprises a plurality of barrier members.

11. The traffic barrier of claim 1, wherein the biasing member comprises a plurality of biasing members.

* * * * *